US008077135B2

(12) United States Patent
Hsu et al.

(10) Patent No.: US 8,077,135 B2
(45) Date of Patent: Dec. 13, 2011

(54) SOURCE DRIVER OF LCD FOR BLACK INSERTION TECHNOLOGY

(75) Inventors: Tien-Chu Hsu, Kaohsiung (TW); Yu-An Liu, Yunlin County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 517 days.

(21) Appl. No.: 12/413,599

(22) Filed: Mar. 29, 2009

(65) Prior Publication Data

US 2010/0177028 A1 Jul. 15, 2010

(30) Foreign Application Priority Data

Jan. 15, 2009 (TW) ..... 98101365 A

(51) Int. Cl.
*G09G 3/36* (2006.01)

(52) U.S. Cl. ..... 345/100; 345/87; 345/99

(58) Field of Classification Search ..... 345/87–100, 345/204, 211
See application file for complete search history.

(56) References Cited

U.S. PATENT DOCUMENTS

| | | | | |
|---|---|---|---|---|
| 7,995,025 | B2 * | 8/2011 | Teranishi | 345/100 |
| 2006/0033696 | A1 * | 2/2006 | Nakamura et al. | 345/100 |
| 2006/0055661 | A1 * | 3/2006 | Kawaguchi | 345/102 |
| 2007/0018939 | A1 * | 1/2007 | Chen et al. | 345/100 |
| 2007/0057959 | A1 * | 3/2007 | Cho et al. | 345/589 |
| 2007/0070019 | A1 * | 3/2007 | Ham | 345/98 |
| 2007/0211009 | A1 * | 9/2007 | Teranishi | 345/98 |
| 2008/0238854 | A1 * | 10/2008 | Kimura | 345/98 |

* cited by examiner

*Primary Examiner* — Nitin Patel
(74) *Attorney, Agent, or Firm* — Winston Hsu; Scott Margo

(57) ABSTRACT

A source driver of an LCD includes a shift register, a set of data latches, and a detection circuit. The shift register includes a plurality of flip-flops for transmitting a start signal. The set of data latches transmits the display data signal according to output signals of the corresponding flip-flops. When the start signal is recognized as a black insertion signal, the detection circuit resets the shift register, and drives the set of data latches to output the black data signal, and transmits the black insertion signal to the next source driver.

10 Claims, 10 Drawing Sheets

| | STH1 | DFF_1 | DFF_2 | DFF_3 | TP1 | DFF_A | DFF_B | DFF_C | TP2 | STH2 |
|---|---|---|---|---|---|---|---|---|---|---|
| t0 | 1 | 0 | 0 | 0 | 0 | 0 | 0 | 0 | 0 | 0 |
| t1 | 1 | 1 | 0 | 0 | 0 | 1 | 0 | 0 | 0 | 0 |
| t2 | 0 | 1 | 1 | 0 | 1 | 1 | 1 | 0 | 0 | 0 |
| t3 | 0 | 0 | 0 | 0 | 0 | 0 | 1 | 1 | 0 | 1 |
| t4 | 0 | 0 | 0 | 0 | 0 | 0 | 0 | 1 | 0 | 1 |
| t5 | 0 | 0 | 0 | 0 | 0 | 0 | 0 | 0 | 0 | 0 |

FIG. 6

| | STH1 | DFF_1 | DFF_2 | DFF_3 | TP1 | DFF_A | DFF_B | DFF_C | TP2 | STH2 |
|---|---|---|---|---|---|---|---|---|---|---|
| t0 | 1 | 0 | 0 | 0 | 0 | 0 | 0 | 0 | 0 | 0 |
| t1 | 0 | 1 | 0 | 0 | 0 | 1 | 0 | 0 | 0 | 0 |
| t2 | 0 | 0 | 1 | 0 | 0 | 0 | 1 | 0 | 1 | 0 |
| t3 | 0 | 0 | 0 | 1 | 0 | 0 | 0 | 0 | 0 | 0 |
| t240 | 0 | 0 | 0 | 0 | 0 | 0 | 0 | 0 | 0 | 1 |
| t241 | 0 | 0 | 0 | 0 | 0 | 0 | 0 | 0 | 0 | 0 |

FIG. 7

SOURCE DRIVER OF LCD FOR BLACK INSERTION TECHNOLOGY

BACKGROUND OF THE INVENTION

1. Field of the Invention

The present invention relates to a source driver of a Liquid Crystal Display (LCD), and more particularly, to a source driver of an LCD for black insertion technology.

2. Description of the Prior Art

The LCD utilizes the spinning of liquid crystal particles to control luminance of the light passing through for displaying different grey levels. Compared to the impulse-type of the Cathode Ray Tube (CRT), the LCD utilizes hold-type. However, since the liquid crystal particles spin continuously, the response time of the LCD is longer than the CRT, which causes worse performance on motion pictures than CRT and therefore generates motion blur. In order to solve motion blur, the LCD inserts black frames between displaying frames for simulating impulse-type of the CRT. The manner for inserting black frames may be, for example, turning on/off the backlight module for inserting black frames, or utilizing the drive circuits to insert black frames.

Please refer to FIG. 1, which is a diagram illustrating data transmission of a conventional LCD. When the LCD uses black frame insertion for writing data, the display data and the black data have to be written interlacingly, which increases the frame rate. As shown in FIG. 1, successive to the $(n+2)^{th}$ and the $(n+3)^{th}$ frames, two black frames are inserted respectively. In this way, when the LCD utilizes black frame insertion, six frames have to be displayed within four frame periods. That is, the frame rate is increased to be 1.5 times the original frame rate.

Please refer to FIG. 2 and FIG. 3. FIG. 2 is a timing diagram illustrating the signals of the source driver. FIG. 3 is a timing diagram illustrating the signals when the source driver writes black data. STH represents the start signal, DATA represents the display data, TP represents the load signal, Tc represents the minimal charging time, and Td1 and Td2 represent the writing time of the display data. As shown in FIG. 2, the source driver outputs the display data DATA to the display panel at the moment A, and the display panel finishes charging at the moment B. As shown in FIG. 3, when the source driver writes the black data, the writing time of the display data DATA is reduced from Td1 to Td2. Even though the charging time Tc falls still within the minimal allowable range, the writing time Td2 possibly reaches the up limit of the capability of the source driver. When the writing time of the display data is reduced, the frame rate is increased. By doing so, when the LCD with great size utilizes the black frame insertion, some problems, e.g. Electromagnetic Interference (EMI), or signal attenuation, may occur. Thus, the writing time of the black data has to be reduced to avoid greatly increasing the frame rate of the LCD.

SUMMARY OF THE INVENTION

Therefore, the present invention provides a source driver for an LCD utilizing black insertion technology.

The present invention provides a source driver. The source driver comprises a shift register comprising a plurality of flip-flops connected for transmitting a start signal, a first set of data latches for transmitting display data according to an output signal of a corresponding one of the plurality of the flip-flops, and a detection circuit for resetting the shift register and driving the first set of the data latches to output black data when the start signal is recognized as a black insertion signal, and transmitting the recognized black insertion signal to a next source driver.

The present invention further provides a method for driving an LCD. The method comprises utilizing a shift register for transmitting a start signal, generating a black insertion signal according to the start signal, resetting the shift register according to the black insertion signal, driving a set of data latches to output black data according to the black insertion signal, and transmitting the black insertion signal to a next source driver.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 6 is a truth table of the signals when the source driver 20 outputs the black data.

FIG. 7 is a truth table of the signals when the source driver 20 outputs the display data.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " Also, the term "electrically connect" is intended to mean either an indirect or direct electrical connection. Accordingly, if one device is coupled to another device, that connection may be through a direct electrical connection, or through an indirect electrical connection via other devices and connections.

Figure 1:
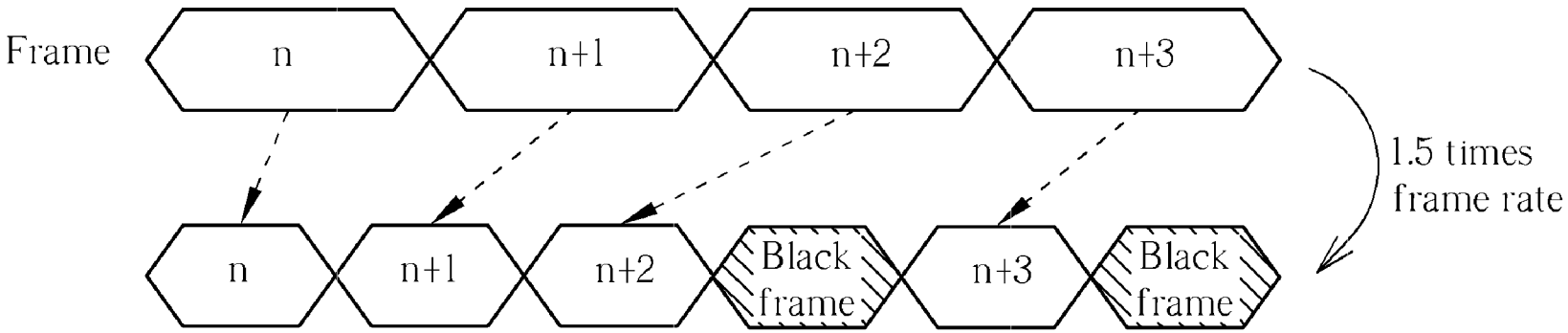
FIG. 1 PRIOR ART
FIG. 1 is a diagram illustrating data transmission of a conventional LCD.
Figure 2:
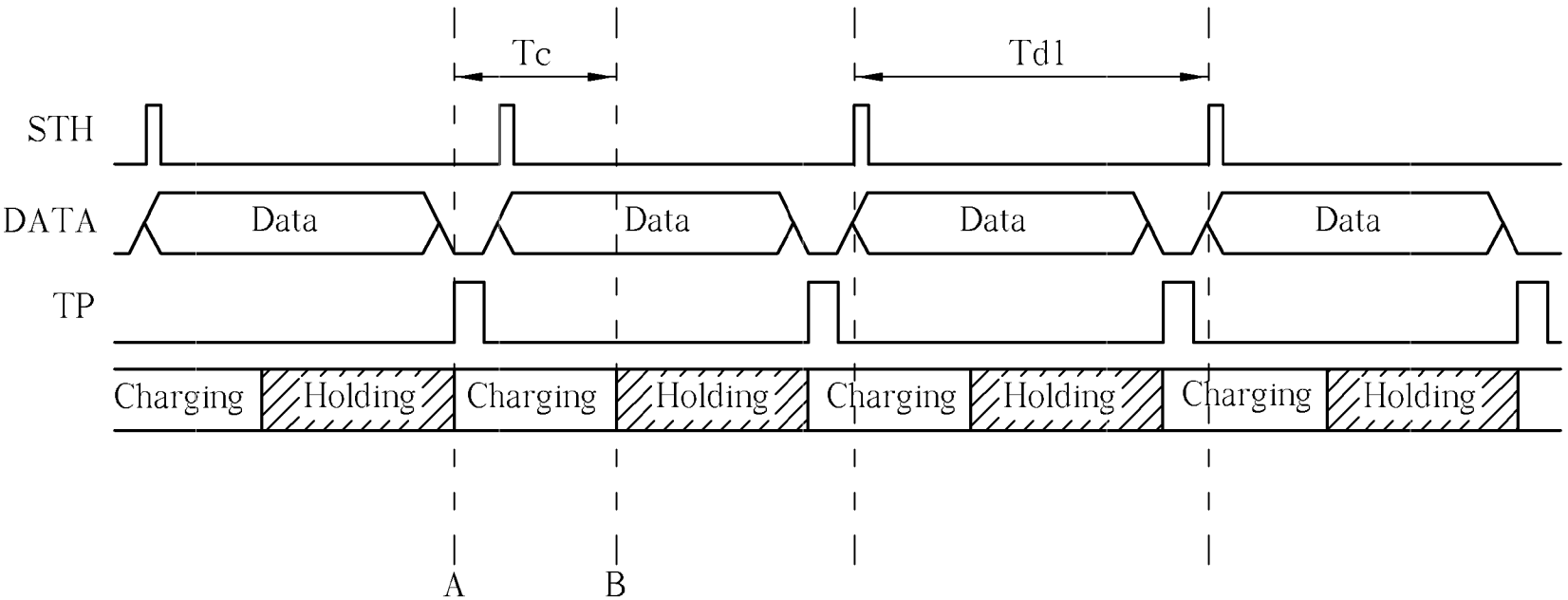
FIG. 2 PRIOR ART
FIG. 2 is a timing diagram illustrating the signals of the source driver.
Figure 3:
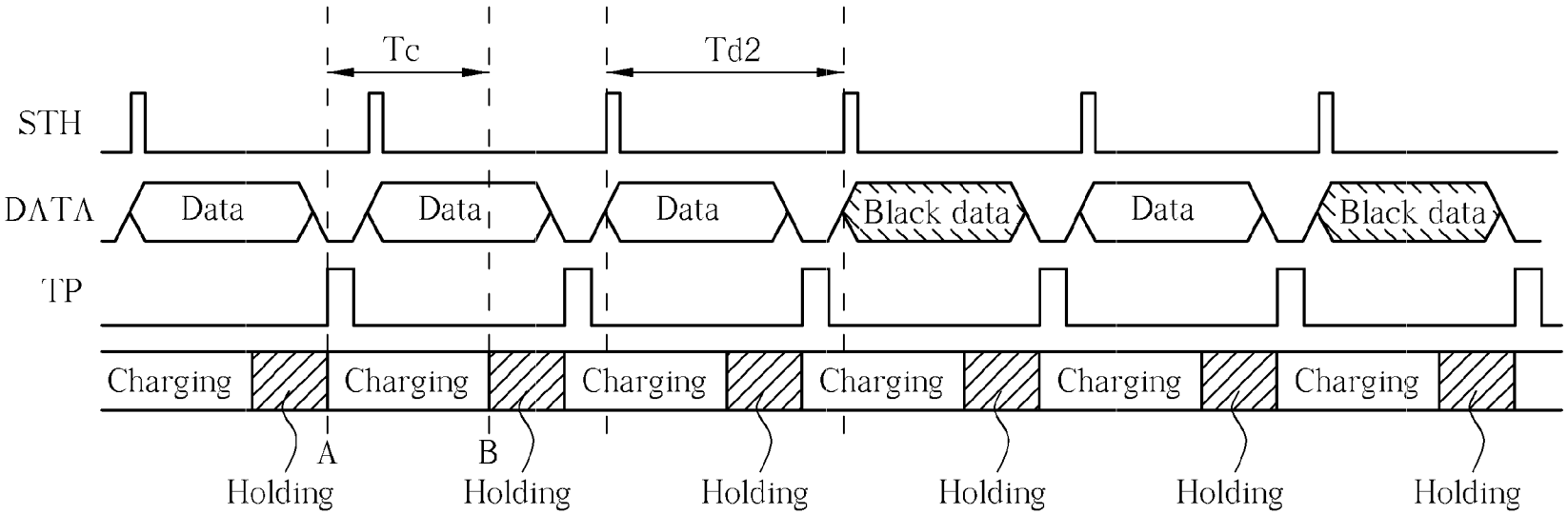
FIG. 3 is a timing diagram illustrating the signals when the source driver writes black data.
Figure 4:
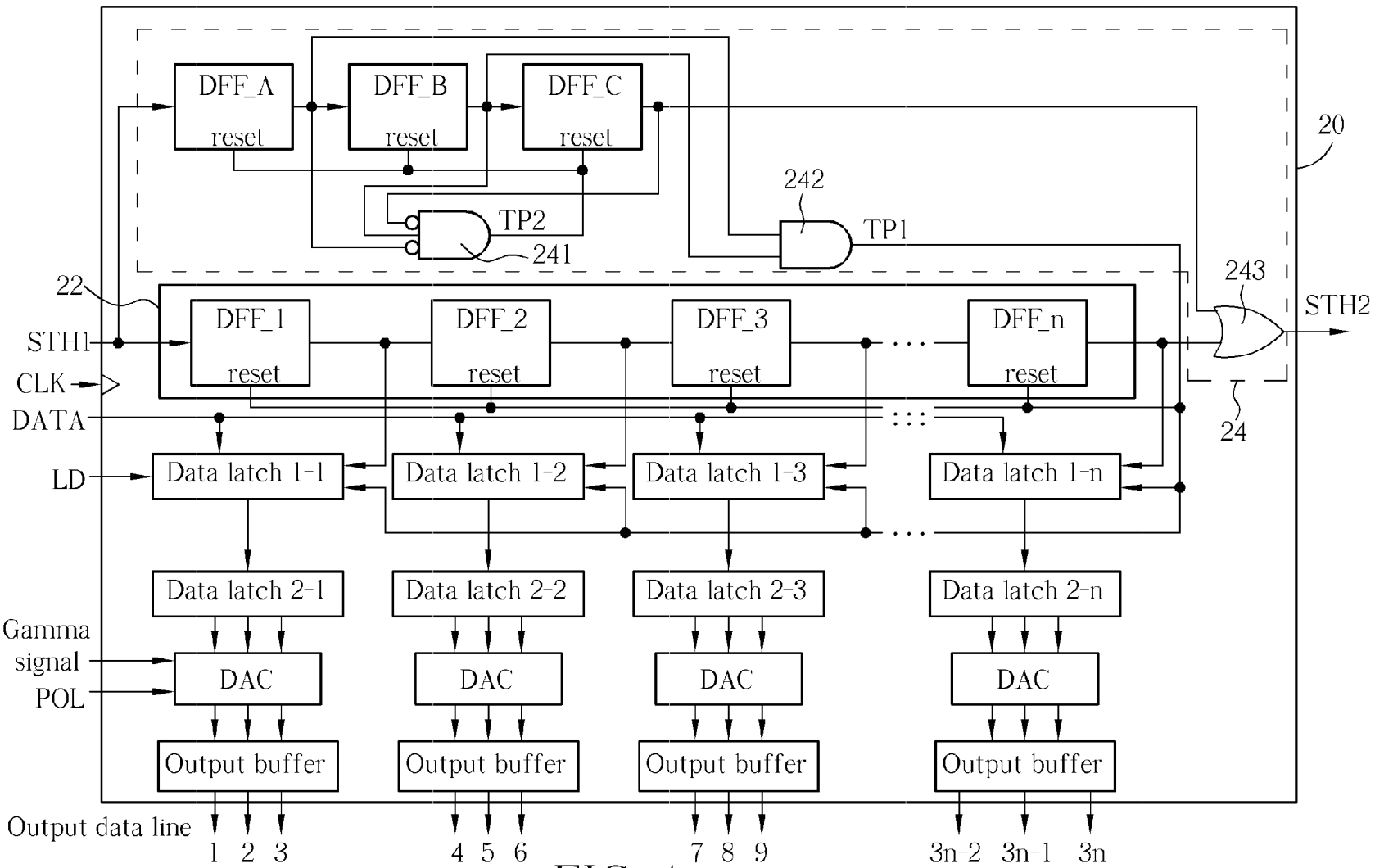
FIG. 4 is a diagram illustrating the source driver of an LCD according to a first embodiment of the present invention.

Please refer to FIG. 4, which is a diagram illustrating the source driver of an LCD according to a first embodiment of the present invention. The source driver 20 comprises a shift register 22, a first set of data latches 1-1~**1-*n*, and a second set of data latches 2-1~2-*n*, a plurality Digital/Analog Converters (DAC), plurality of output buffers, and a detection circuit 24. The shift register 22 comprises a plurality of flip-flops DFF_1~DFF_n for transmitting a first start signal STH1. The first set of data latches 1-1~1-*n*** transmit the display data DATA or the black data to the second set of the data latches 2-1~2-*n* according to the output signal of the corresponding flip-flop, the load signal LD and the first control signal TP1. The second set of the data latches transform the display data to digital data of three channels. The plurality of the DACs convert the digital data stored in the second set of the data latches 2-1~2-*n* to analog data according to the gamma signal and the polarity signal POL. Finally, the converted analog data are transmitted from the output buffers to the output data lines 1~3*n*.

The detection circuit 24 comprises a first AND gate 241, a first flip-flop DFF_A, a second flip-flop DFF_B, a third flip-flop DFF_C, a second AND gate, and an OR gate 243. The first AND gate 241 receives the output signals respectively from the flip-flops DFF_A, DFF_B, and DFF_C, wherein the output ends of first flip-flop DFF_A and the third flip-flop DFF_C are electrically connected to the two input ends of the first AND gate 241 respectively through two inverters. The second AND gate 242 receives the output signals from the first flip-flop DFF_A and the second flip-flop DFF_B. The source driver 20 of the present invention utilizes the detection circuit 24 to finish fast writing black data. When the first start signal STH1 is recognized as a black insertion signal, the first control signal TP1 generated by the detection circuit 24 resets the shift register 22. Consequently, the source driver 20 outputs the second start signal STH2 according to the detection circuit 24, and the first set of the data latches 1-1~1-*n* output black data according to the first control signal TP1. When the data stored in the first two registers of the shift register 22 are both high, which means the first start signal STH1, having the pulse that lasts for two cycle of the clock signal CLK, is inputted to the source driver 20, the data stored in the first set of the data latches 1-1~1-*n* are all set to be low, which means the data stored in the first set of the data latches 1-1~1-*n* are all black data, and further data stored in the shift register 22 are all erased to be low. Then the second start signal STH2 consecutively outputs a pulse that lasts high for two cycles of the clock signal CLK to allow the next source driver to set the data stored in the data latches of that next source driver to be black data.

Figure 5:
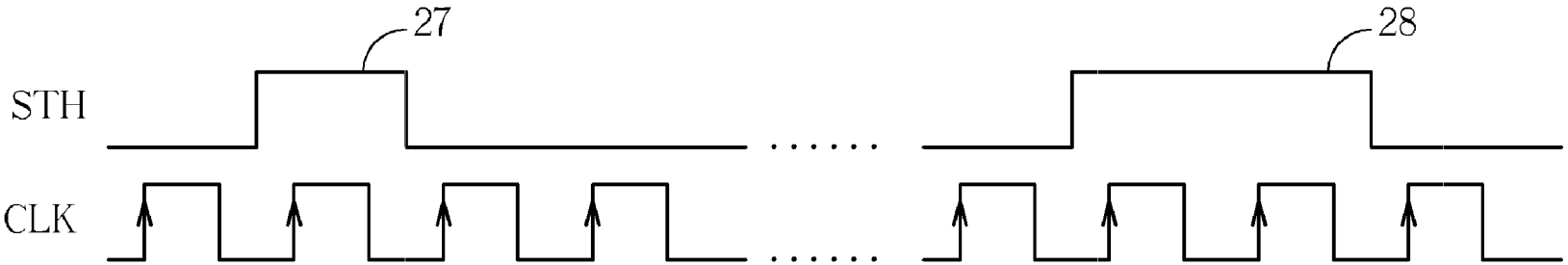
FIG. 5 is a timing diagram illustrating the start signal STH and the clock signal CLK.

Please refer to FIG. 5, which is a timing diagram illustrating the start signal STH and the clock signal CLK. The source driver 20 outputs the display data or the black data according to the first start signal STH1. When the pulse of the first start signal STH1 lasts high for only one cycle of the clock signal CLK, the first start signal STH1 is recognized as a normal operation signal 27, and thus the source driver 20 outputs the display data. When the pulse of the first start signal STH1 lasts high for two cycles of the clock signals, the first start signal STH1 is recognized as a black insertion signal 28, and thus the source driver 20 outputs the black data.

Please refer to FIG. 6, which is a truth table of the signals when the source driver 20 outputs the black data. At the moment t0, the first start signal STH1 is high. At the moment t1, the shift register 22 starts to shift. At the moment t2, the first control signal TP1 is logic 1, and at the next moment, the data stored in the shift register 22 are erased. At the moment t3, the first set of the flip-flops 1-1~1-*n* are set to output black data, and the second start signal STH2 outputs logic 1. At the moment t4, the second start signal STH2 is logic 1 again, which allows the next source driver to output the black data. At the moment t5, the source driver 20 finishes the outputting of the black data. When the first start signal STH1 is recognized as a black insertion signal 28, the first start signal STH1 is logic 1 at both of the moments t0 and t1. The first control signal TP1, generated from the second AND gate 242, is logic 1 at the moment t2, so that the shift register 22 will be reset at the moment t3, and therefore the first set of the data latches 1-1~1-*n* output the black data. Since the shift register 22 is reset at the moment t3, the source driver 20 outputs the second start signal STH2 according to the detection circuit 24. The second start signal STH2 is logic 1 at both of the moments t3 and t4, and is transmitted to the next source driver as a black insertion signal 28. In this way, the source driver 20 finishes outputting the black data at the moment t5 by the detection circuit 24.

Please refer to FIG. 7, which is a truth table of the signals when the source driver 20 outputs the display data. At the moment t0, the first start signal STH1 is logic 1. At the moment t1, the shift register 22 starts to shift. At the moment t2, the second control signal TP2 outputs logic 1 for erasing the data stored in the first flip-flop DFF_A, the second flip-flop DFF_B, and the third flip-flop DFF_C. At the moment t3, the shift register 22 continues to shift. At the moment t240, the second start signal STH2 outputs logic 1. At the moment t241, the source driver 20 finishes the outputting of the display data. When the first start signal STH1 is recognized as the normal operation signal 27, the first start signal STH1 is logic 1 at the moment t0, and is fed forward through the shift register 22. The second control signal TP2 generated from the first AND gate 241, at the moment t2, is logic 1, so that at the moment t3, the first flip-flop DFF_A, the second flip-flop DFF_B, and the third flip-flop DFF_C are reset. At the moment t240, the source driver 20 outputs the second start signal STH2 according to the output of the shift register 22. Consequently, at the moment t241, the source 20 finishes the outputting of the display data.

Figure 8:
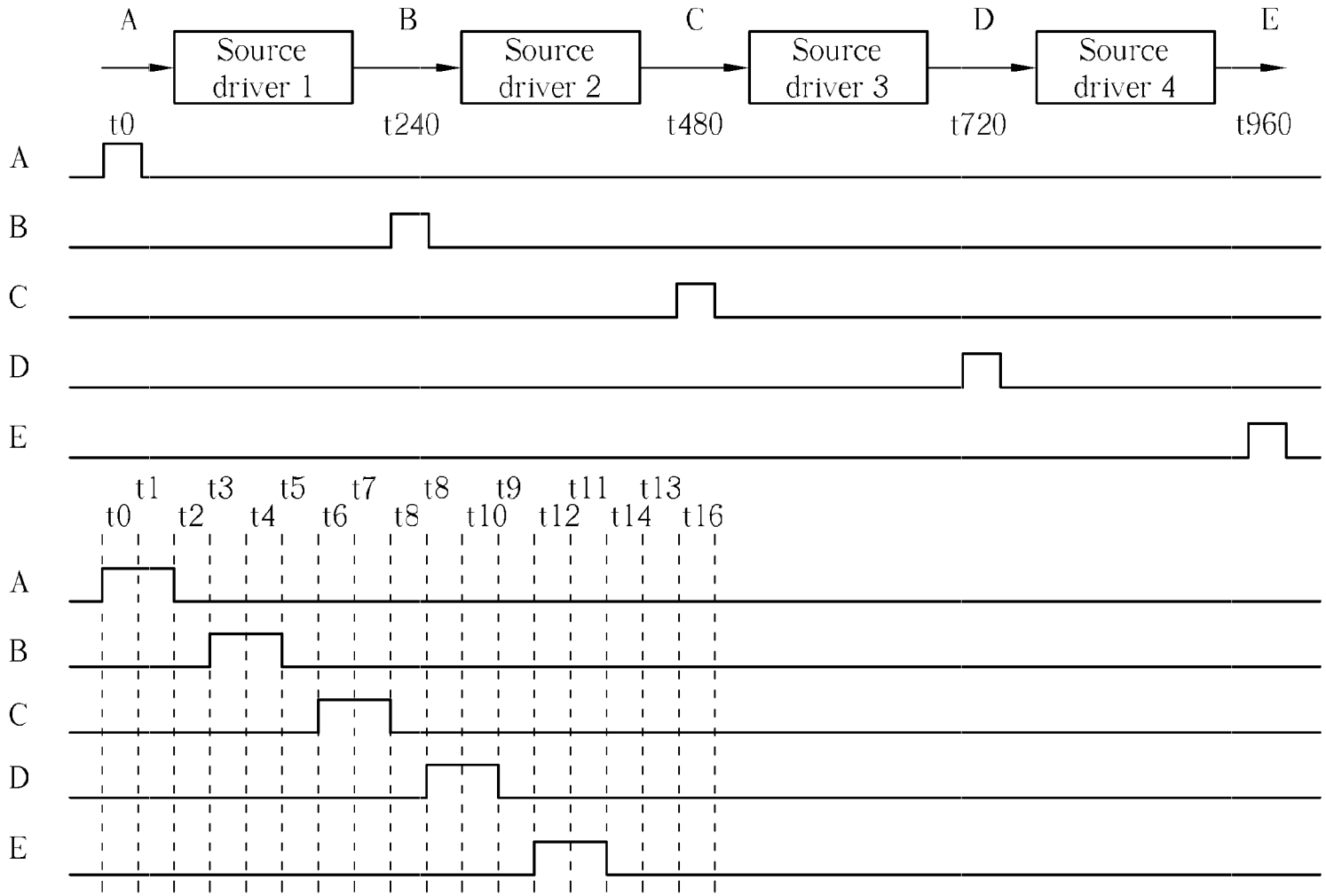
FIG. 8 is a timing diagram illustrating the signals when the source driver outputs the display data and the black data.

Please refer to FIG. 8. FIG. 8 is a timing diagram illustrating the signals when the source driver outputs the display data and the black data. According to the calculation from the truth tables of FIGS. 6 and 7, one source driver requires four triggers to finish the setting of the black data, wherein one trigger is shared by two adjacent source drivers. Therefore, under the condition of four source drivers, to finish the setting of one black data, it costs 13 (4×3+1=13) cycles of the clock signal CLK, which is shown in FIG. 8.

Figure 9:
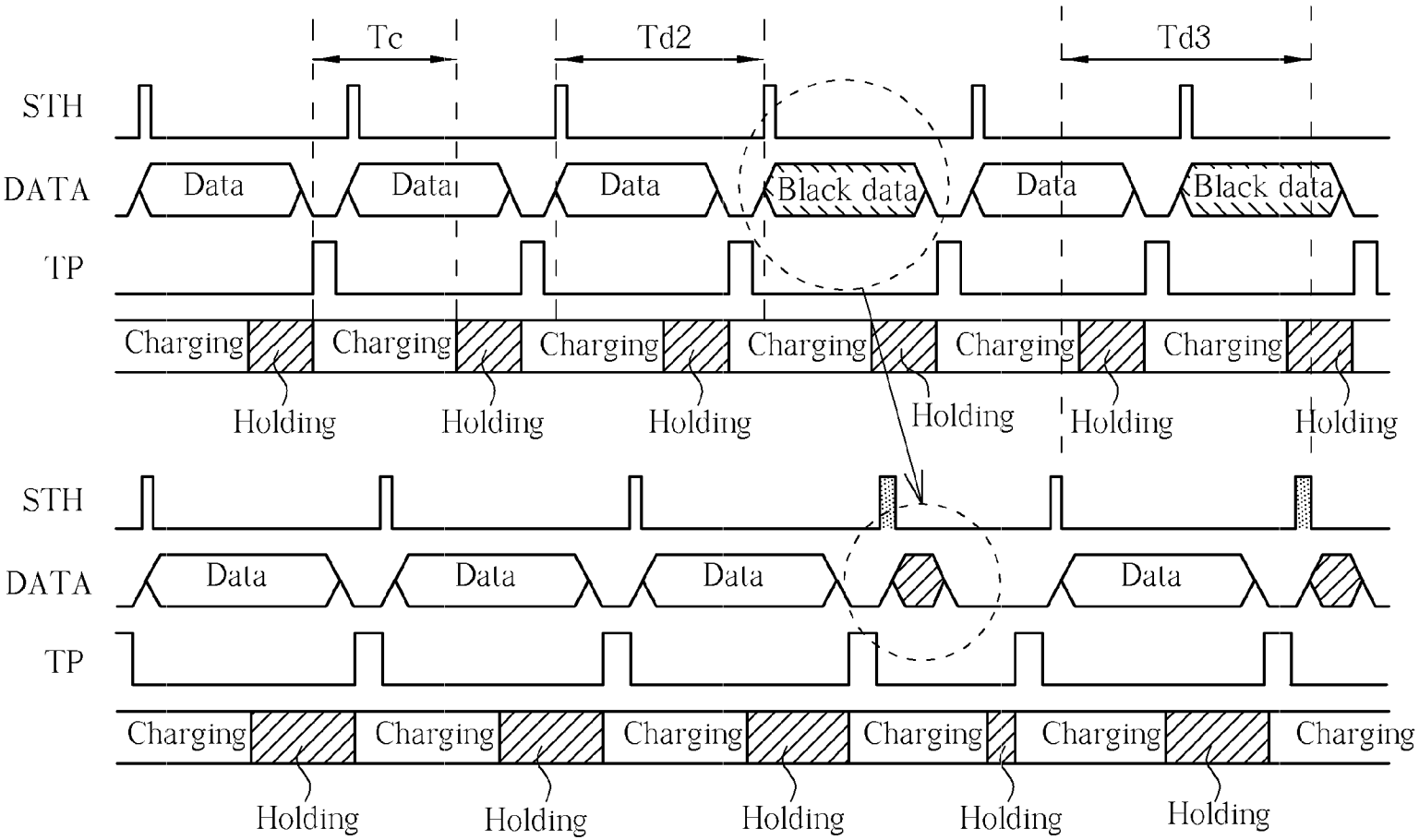
FIG. 9 is a timing diagram comparing the signals of source drivers of the present invention and the prior art.

Please refer to FIG. 9, which is a timing diagram comparing the signals of source drivers of the present invention and the prior art. The upper part of FIG. 9 is a timing diagram illustrating the signals when the source driver of the prior art writes the black data. The lower part of FIG. 9 is a timing diagram illustrating the signals when the source driver of the present invention writes the black data. STH represents the start signal, DATA represents the display data, TP represents the load signal, Tc represents the minimal charging time of the LCD panel, and Td2 and Td3 represent the writing time of the display data. The source driver of the present invention outputs the display data or the black data according to the start signal STH. More particularly, the source driver of the present invention utilizes the start signal STH as the black insertion signal when the start signal STH carries a pulse having a width for two cycles of the clock signal CLK in order to control the data latches to output the black data. Apparently, the writing time of the black data of the source driver of the present invention is reduced, so that the writing time of the display data can be increased from Td2 to Td3. In this way, the frame rate of the LCD does not increase too much because of the source driver of the present invention.

Figure 10:
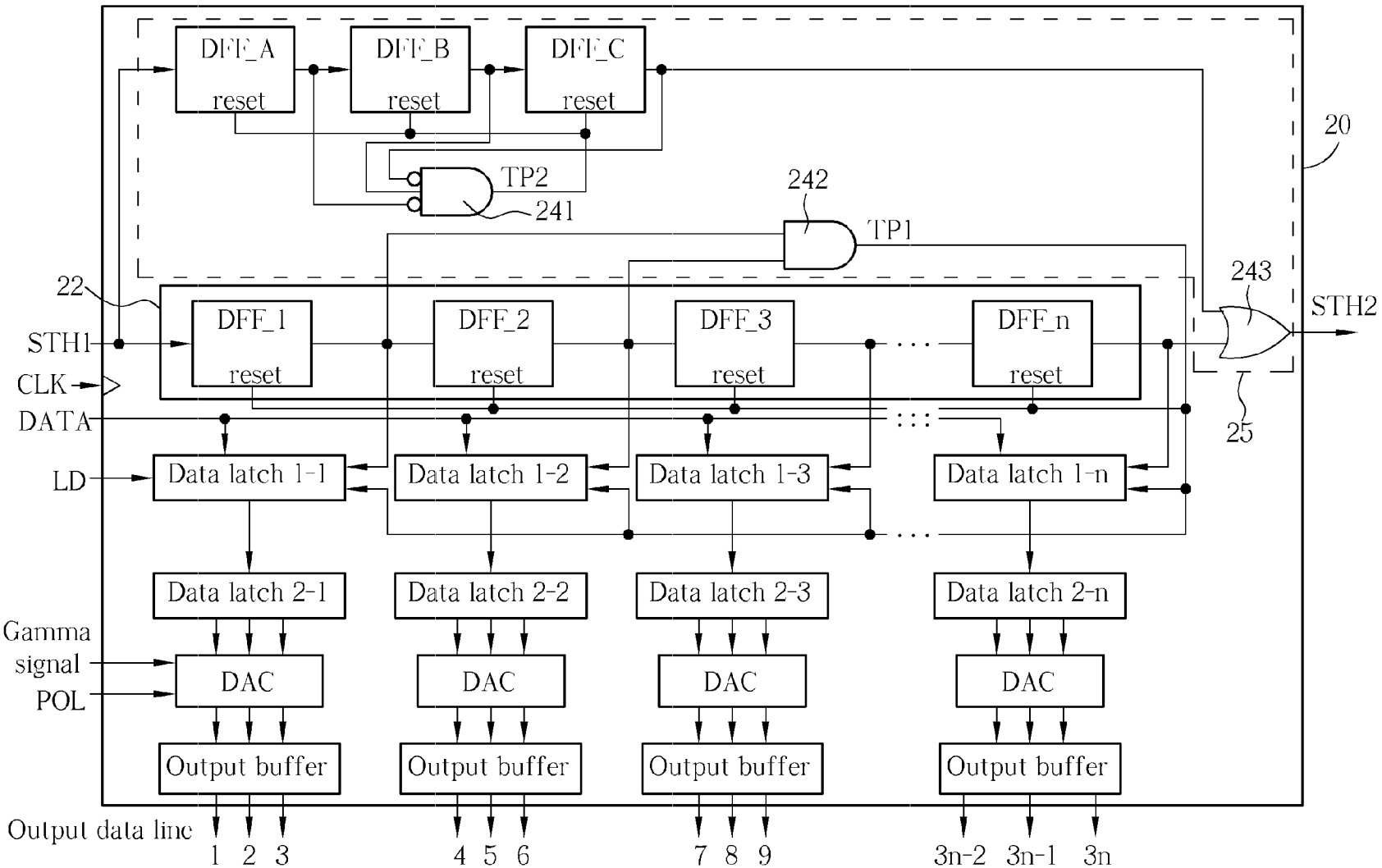
FIG. 10 is a diagram illustrating the source driver of an LCD according to a second embodiment of the present invention.

Please refer to FIG. 10. FIG. 10 is a diagram illustrating the source driver of an LCD according to a second embodiment of the present invention. In the second embodiment of the present invention, the connections of the detection circuit 25 and the second AND gate 242 are different from those of the first embodiment of the present invention. The second AND gate 242 receives the output signals from the first flip-flop DFF_1 and the second flip-flop DFF_2 of the shift register 22. The operational principles of the second embedment of the present invention are similar to those of the first embodiment of the present invention and will not be repeated again for brevity.

According to the embodiments of the present invention, the source driver 20 utilizes the shift register 22 for transmitting the first start signal STH1, and further utilizes the first set of the data latches 1-1~1-*n* for outputting the display data DATA according to the first start signal. When the source driver 20 writes the black data, the start signal STH1 carries a pulse having a width for two cycles of the clock signal for being recognized as the black insertion signal, which resets the shift register 22, and further drives the first set of the data latches 1-1~1-*n* to output the black data. Finally, the start signal STH1 is transmitted to the next source driver.

To sum up, the source driver of the LCD of the present invention comprises a shift register, a set of data latches, and a detection circuit. The shift register comprises a plurality of flip-flops for transmitting a start signal. The set of the data latches transmits the display data according to the output of the corresponding flip-flops. When the start signal is recognized as a black insertion signal, the detection circuit resets the shift register and drives the set of the data latches to output the black data, and transmits the recognized black insertion signal to the next source driver.

Those skilled in the art will readily observe that numerous modifications and alterations of the device and method may be made while retaining the teachings of the invention.

What is claimed is:

1. A source driver, comprising:

a shift register, comprising a plurality of flip-flops connected for transmitting a start signal;

a first set of data latches for transmitting display data according to an output signal of a corresponding one of the plurality of the flip-flops; and a detection circuit for resetting the shift register and driving the first set of the data latches to output black data when the start signal is recognized as a black insertion signal, and transmitting the recognized black insertion signal to a next source driver.

2. The source driver of claim 1, wherein the detection circuit comprises:

a plurality of flip-flops connected in series for temporarily storing the start signal;

a first logic gate electrically connected to the plurality of the flip-flops connected in series for generating a reset signal to reset the plurality of the flip-flops connected in series;

a second logic gate for generating a control signal according to the start signal to drive the first set of the data latches to output the black data; and a third logic gate electrically connected to the plurality of the flip-flops connected in series and the shift register for outputting the start signal.

3. The source driver of claim 1, wherein the detection circuit comprises:

a first AND gate, comprising a first input end, a second input end, a third input end, and an output end;

a first flip-flop, comprising an input end for receiving the start signal, an output end electrically connected to the first input end of the first AND gate through a first inverter, and a reset end electrically connected to the output end of the first AND gate;

a second flip-flop, comprising an input end electrically connected to the output end of the first flip-flop, an output end electrically connected to the second input end of the first AND gate, and a reset end electrically connected to the output end of the first AND gate;

a third flip-flop, comprising an input end electrically connected to the output end of the second flip-flop, an output end electrically connected to the third input end of the first AND gate through a second inverter, and a reset end electrically connected to the output end of the first AND gate;

a second AND gate, comprising a first input end electrically connected to the output end of the first flip-flop, a second input end electrically connected to the output end of the second flip-flop, and an output end electrically connected to the shift register and the first set of the data latches; and an OR gate, comprising a first input end electrically connected to the output end of the third AND gate, a second input end electrically connected to an output end of the shift register, and an output end electrically connected to the next source driver.

4. The source driver of claim 1, wherein the detection circuit comprises:

a first AND gate, comprising a first input end, a second input end, a third input end, and an output end;

a first flip-flop, comprising an input end for receiving the start signal, an output end electrically connected to the first input end of the first AND gate through an inverter, and a reset end electrically connected to the output end of the first AND gate;

a second flip-flop, comprising an input end electrically connected to the output end of the first flip-flop, an output end electrically connected to the second input end of the first AND gate, and a reset end electrically connected to the output end of the first AND gate;

a third flip-flop, comprising an input end electrically connected to the output end of the second flip-flop, an output end electrically connected to the third input end of the first AND gate through an inverter, and a reset end electrically connected to the output end of the first AND gate;

a second AND gate, comprising a first input end electrically connected to the output end of the first flip-flop of the shift register, a second input end electrically connected to the output end of the second flip-flop of the shift register, and an output end electrically connected to the shift register and the first set of the data latches; and an OR gate, comprising a first input end electrically connected to the output end of the third AND gate, a second input end electrically connected to an output end of the shift register, and an output end electrically connected to the next source driver.

5. The source driver of claim 1, wherein the start signal is recognized as the black insertion signal when the start signal carries a pulse lasting for two cycles of a clock signal.

6. The source driver of claim 5, wherein the detection circuit comprises three flip-flops for temporarily storing the start signal.

7. The source driver of claim 1, further comprising:

a second set of data latches for transforming the display data to digital data of three channels;

a plurality of digital/analog converters for converting the digital data to analog data; and a plurality of output buffers for outputting the analog data.

8. A method for driving an LCD, the method comprising:

utilizing a shift register for transmitting a start signal;

generating a black insertion signal according to the start signal;

resetting the shift register according to the black insertion signal;

driving a set of data latches to output black data according to the black insertion signal; and transmitting the black insertion signal to a next source driver.

9. The method of claim 8, wherein generating a black insertion signal according to the start signal comprises recognizing the start signal as the black insertion signal when the start signal carries a pulse lasting two cycles of a clock signal.

10. The method of claim 8, further comprising:

utilizing the set of the data latches to output display data according to the start signal.

* * * * *